US010208578B2

(12) United States Patent
Perkins et al.

(10) Patent No.: US 10,208,578 B2
(45) Date of Patent: Feb. 19, 2019

(54) MOVING INJECTION GRAVITY DRAINAGE FOR HEAVY OIL RECOVERY

(71) Applicant: LINC ENERGY LTD, Brisbane, Queensland (AU)

(72) Inventors: Greg Martin Parry Perkins, Brisbane (AU); Casper Jan Hendrik Burger, Brisbane (AU)

(73) Assignee: Martin Parry Technology Pty Ltd., Brisbane, Queensland ( * ) Notice: Subject to any disclaimer, the term of this patent is extended or adjusted under 35 U.S.C. 154(b) by 0 days.

(21) Appl. No.: 15/570,370

(22) PCT Filed: Mar. 23, 2016

(86) PCT No.: PCT/AU2016/000106
§ 371 (c)(1),
(2) Date: Oct. 30, 2017

(87) PCT Pub. No.: WO2016/172757
PCT Pub. Date: Nov. 3, 2016

(65) Prior Publication Data

US 2018/0128089 A1 May 10, 2018

(30) Foreign Application Priority Data

Apr. 28, 2015 (AU) ..... 2015901552

(51) Int. Cl.
*E21B 43/24* (2006.01)
*E21B 43/243* (2006.01)

(52) U.S. Cl.
CPC ..... *E21B 43/2406* (2013.01); *E21B 43/243* (2013.01)

(58) Field of Classification Search
CPC ..... E21B 43/2406; E21B 43/243
USPC ..... 166/272.3
See application file for complete search history.

(56) References Cited

U.S. PATENT DOCUMENTS 7,814,968 B2 10/2010 Bizon
2013/0020076 A1* 1/2013 Schneider ..... E21B 36/02 166/261
2013/0098603 A1* 4/2013 Kerr ..... E21B 43/2408 166/245

FOREIGN PATENT DOCUMENTS

WO 2012025150 A1 3/2012

OTHER PUBLICATIONS

International Search Report and Written Opinion for International Application No. PCT/AU2016/000106, dated Aug. 29, 2016, 11 Pages.

* cited by examiner

*Primary Examiner* — Angela M DiTrani Leff
*Assistant Examiner* — Ashish K Varma
(74) *Attorney, Agent, or Firm* — EcoTech Law Group, P.C.

(57) ABSTRACT

The invention provides methods for mobilizing and recovering petroleum from subterranean formations by in situ combustion.

19 Claims, 6 Drawing Sheets

MOVING INJECTION GRAVITY DRAINAGE FOR HEAVY OIL RECOVERY

TECHNICAL FIELD

This invention relates to recovery of hydrocarbons from subterranean formations. In particular, methods for mobilising and recovering petroleum by in-situ combustion are disclosed.

BACKGROUND ART

In-situ combustion (ISC) processes are utilised for the purpose of recovering petroleum from heavy oil, oil sands, and bitumen reservoirs. In the process, oil is heated and displaced to a production well for recovery. Historically, in-situ combustion involves providing spaced apart vertical injection and production wells within an underground reservoir. Typically, an injection well is located within a pattern of surrounding production wells. An oxidant, such as air, oxygen enriched air, or oxygen, is injected through the injection well into the reservoir, allowing combustion of a portion of the hydrocarbons in the reservoir in-situ. The heat of combustion and the hot combustion products warm a portion of the reservoir adjacent to the combustion front and displace hydrocarbons toward offset production wells.

One of the challenges associated with existing ISC processes is that cold hydrocarbons surrounding a production well can be so viscous as to prevent warmed and displaced hydrocarbons from reaching the production well, eventually quenching the combustion process. Another challenge of traditional ISC processes is that petroleum reservoirs are heterogeneous, and therefore preferential pathways for a combustion front develop, invariably leading to combustion front breakthrough into one of the production wells before the others. The impact of this is that overall oil recovery from the pattern of injection and production wells is generally quite low.

The traditional application of ISC has been with a Fire Flood conducted using a pattern of vertical wells drilled into the target oil reservoir. Various patterns, including 5-spot, 7-spot and 9-spot, have been attempted.

An alternative implementation of the ISC technique is the application of a line drive from a row of injectors to a row of producers. Such ISC line drives have been successful in only a few reservoirs. For example, where an ISC line drive has been successful the key ingredients for success have been attributed to (i) reservoir dip (allowing oil warmed around the injection well to flow via gravity to the production wells) and (ii) keeping the spacing between injector and producer wells relatively low (A. T. Turta, S. K. Chattopadhyay, R. N. Bhattacharya, A. Condrachi and W. Hanson, "Current Status of Commercial In Situ Combustion Projects Worldwide", Journal of Canadian Petroleum Technology, v46, n11, pp 1-7, 2007).

Various implementations of the ISC technique, such as the "toe heel air injection" (THAI) process (U.S. Pat. No. 5,626,191; T. X. Xia, M. Greaves, A. T. Turta, and C. Ayasse, "THAI—A 'Short-Distance Displacement' In Situ Combustion Process for the Recovery and Upgrading of Heavy Oil", Trans IChemE, Vol 81, Part A, pp 295-304, March 2003), call for the use of horizontal production wells to provide a conduit for displaced hydrocarbons to flow from a heated region to a production wellhead. The THAI process relies on the deposition of petroleum coke in slots of a perforated liner in the horizontal section of a production wellbore behind the combustion front. However, should the coke deposition not take place or not be deposited evenly enough to seal off the liner, the injected oxidant is able to short-circuit between injection and production wells, bypassing the combustion front and unrecovered hydrocarbons.

Additionally, the THAI process incorporates vertical injection wells, so that the path of injected oxidant is very much affected by reservoir permeability distribution. As a result, performance in field trials illustrates that the formation of a well-developed combustion front that is effective in mobilising oil to the horizontal production well is difficult to achieve at commercial scale.

Field results from THAI projects show that the combustion front moves very slowly through the reservoir and that mobilised oil rates are typically in the order of 20 to 80 bpd per production well, with air oil ratios (AORs) of over 5,000 m3/m3. In several wells cumulative AORs were above 10,000 m3/m3 (Petrobank Energy and Resources, "2011 Confidential Performance Presentation Whitesands Pilot Project", Annual report to Alberta Energy Regulator, April 2012, https://www.aerca/documents/oilsands/insitu-presentations/2012AthabascaPetrobankWhitesands9770.pdf). At these low levels of oil production per well and high levels of air injection per barrel of oil produced, the process is not economically viable. An evolution of the original THAI concept is to install multiple vertical injection wells, in the so called MULTI-THAI process, to inject more air into the reservoir. However, field results are also not encouraging, as the process still relies on the injection of the oxidant via an immoveable vertical well, and hence the location and behaviour of the combustion front cannot be effectively controlled.

Another thermal recovery technique is the recently proposed combustion assisted gravity drainage (CAGD) process (H. Rahnema and D. D. Mamora, "Combustion Assisted Gravity Drainage (CAGD) Appears Promising", Society of Petroleum Engineers, SPE Paper 135821, 2010; H. Rahnema, M. A. Barrufet, "Self-Sustained CAGD Combustion Front Development; Experimental and Numerical Observations", Society of Petroleum Engineers, SPE Paper 154333, 2012; H. Rahnema, M. A. Barrufet and D. D. Mamora, "Experimental analysis of Combustion Assisted Gravity Drainage", Journal of Petroleum Science and Engineering, v103, pp 85-95, 2013). In this process, pairs of horizontal wells are drilled into underground oil sands and heavy oil formations to develop a combustion chamber and combustion front in the formation, from the upper horizontal well, to mobilise warming and recovery of heavy oil from the lower horizontal wells.

The CAGD process shows promise when conducted in the laboratory (H. Rahnema, M. A. Barrufet, "Self-Sustained CAGD Combustion Front Development; Experimental and Numerical Observations", Society of Petroleum Engineers, SPE Paper 154333, 2012; H. Rahnema, M. A. Barrufet and D. D. Mamora, "Experimental analysis of Combustion Assisted Gravity Drainage", Journal of Petroleum Science and Engineering, v103, pp 85-95, 2013). However, the CAGD process has not been implemented in the field and the obvious potential drawbacks include: poor distribution of oxidant along the horizontal well, low oxidant flux into the formation, and the tendency of oxidant to preferentially bypass the reservoir in zones with high permeability (e.g., reservoir regions with fractures). These issues will lead to poor recovery of the oil from the reservoir and high operating costs, due to the inefficient use of the injected air/oxidant.

A thermal recovery technique widely used today is steam assisted gravity drainage (SAGD). In this process, pairs of horizontal wells are drilled into underground oil sands and heavy oil formations. Steam is then injected into the formation through the upper well to warm the heavy oil deposits, enabling hydrocarbons to flow out of the formation and into the lower well. From there, the hydrocarbons are lifted to the surface. However, the SAGD process has a number of drawbacks, including the generation of high $CO_2$ emissions as a by-product of steam generation, and the need to manage large volumes of water. Typically 3 to 4 barrels of water must be handled for every barrel of oil produced. SAGD methods are most effective in relatively high-permeable reservoirs, and where the reservoir thickness is greater than 10 meters. However, many heavy oil formations are tight and thin, making them unattractive candidates for SAGD. As reservoir quality declines, the performance of SAGD also declines and the amount of water which needs to be handled increases, sometimes over 5 barrels of water per barrel of oil.

Additionally, as SAGD utilises the latent heat of steam to heat and mobilise oil, the preferred reservoir depth is typically between 250 and 500 meters, where sufficiently high SAGD operating pressures can be maintained. Shallow reservoirs with lower pressures cannot be operated at sufficiently high temperatures to effectively mobilise oil. In contrast, deep reservoirs with higher pressures require high temperature steam and risk excessive heat loss in the injection well, such that the steam quality is insufficient to efficiently mobilise oil once it enters the reservoir. Accordingly, the SAGD process is only a viable candidate for working a relatively small subset of the heavy oil reservoirs that exist.

Therefore, a need exits for improved methods for recovering heavy hydrocarbons from subterranean formations.

SUMMARY OF INVENTION

An object of the present invention is to provide a method for the recovery of hydrocarbons from subterranean formations, including, for example, heavy oil, oil sands, and bitumen reservoirs. A key feature of these oil formations is that the oil has a relatively high viscosity, which makes it have low mobility, or even no mobility, in the reservoir under natural conditions.

Another feature of the oil formations targeted with the present invention is that the reservoirs are heterogeneous; that is, that zones with different properties exist in the reservoirs. For example, zones of high or low permeability; zones of high or low oil saturation; zones of high or low porosity; zones of high or low water saturation; and so forth.

Processes such as SAGD, work best in formations with low heterogeneity, where the injected fluids can be distributed uniformly over the injection well when being injected into the reservoir. Techniques have been implemented to reduce the variability of the flux of injected steam in SAGD along the horizontal wells when operating in heterogeneous reservoirs, but these are generally only partially successful.

In one aspect, the invention provides a method for recovering petroleum from a hydrocarbon-bearing subterranean formation, wherein the formation is intersected by at least one completed well-pair comprising a first generally horizontal well (sometimes referred to as an "injection well") and a second generally horizontal well (sometimes referred to as a "production well") situated below the first well, including the steps of: a) positioning a tubing string in the first well and in the second well, b) injecting steam into the formation via the tubing string positioned in the first well and/or the tubing string positioned in the second well, c) withdrawing petroleum that moves downwardly (via gravity) in the formation and flows into the second well, from the second well, d) replacing steam injection into the formation via the tubing string positioned in the first well with oxidant injection once the temperature of a region of the formation proximate the first well reaches the auto-ignition temperature of in-situ hydrocarbons, whereby auto-ignition of in-situ hydrocarbons commences, e) withdrawing petroleum that moves downwardly (via gravity) in the formation and flows into the second well, from the second well, f) retracting the tubing string positioned in the first well as desired while maintaining oxidant injection into the formation to support/maintain combustion of in-situ hydrocarbons, and g) continuing to withdraw petroleum that moves downwardly (via gravity) in the formation and flows into the second well, from the second well.

In one embodiment, the method further includes the step, after step (b), of ceasing injecting steam into the formation and allowing the injected steam to soak into the formation.

In another embodiment, the method further includes the step of injecting a quench fluid (e.g., water or a hydrocarbon) into the formation via the tubing string positioned in the first well and/or the tubing string positioned in the second well following auto-ignition of in-situ hydrocarbons. Such an injection of a quench fluid can be used to maintain the temperature of the first and/or second well below about 450° C.

In another aspect, the invention provides a method for recovering petroleum from a hydrocarbon-bearing subterranean formation, including the steps of: a) completing at least one well-pair comprising a first generally horizontal well (sometimes referred to as an "injection well") and a second generally horizontal well (sometimes referred to as a "production well") situated below the first well in the formation, b) positioning a tubing string in the first well and in the second well, c) injecting steam into the formation via the tubing string positioned in the first well and/or the tubing string positioned in the second well, d) withdrawing petroleum that moves downwardly (via gravity) in the formation and flows into the second well, from the second well, e) replacing steam injection into the formation via the tubing string positioned in the first well with oxidant injection once the temperature of a region of the formation proximate the first well reaches the auto-ignition temperature of in-situ hydrocarbons, whereby auto-ignition of in-situ hydrocarbons commences, f) withdrawing petroleum that moves downwardly (via gravity) in the formation and flows into the second well, from the second well, g) retracting the tubing string positioned in the first well as desired while maintaining oxidant injection into the formation to support/maintain combustion of in-situ hydrocarbons, and h) continuing to withdraw petroleum that moves downwardly (via gravity) in the formation and flows into the second well, from the second well.

A key feature of the present invention is that one or more oxidant injection locations is established along the horizontal well, via the present design in which an arrangement of multiple injection points from the tubing string are aligned with the arrangement of open area, in the form of slots and/or mesh, in the horizontal well liner.

Another key feature of the present invention is that the location of the combustion fronts established by injecting an oxidant (e.g., air, enriched air or pure oxygen) into the formation are controlled by moving the tubing string located within the completed injection well. The moving of the oxidant injection points enables efficient recovery of in-situ hydrocarbons, as zones with low productivity for hydrocarbon recovery (i.e., those with low permeability, low oil saturation, or zones which are highly fractured) can be skipped, enabling the targeting of those zones with high productivity for oil recovery.

In addition, by targeting reservoir zones periodically, via moving the oxidant injection points, the surface area of the active combustion front can be controlled, thereby ensuring the oxidant flux is sufficient to maintain the combustion process in the high temperature oxidation (HTO) regime. This ensures that the oxidant is used efficiently to generate heat which warms and mobilises the surrounding oil. Thus, periodically the retraction of the oxidant injection points maintains the surface area of in-situ combustion within an allowable range (i.e., every retraction reduces the in-situ combustion surface area) of oxidant flux, heat flux generated, and heat loss to the formation and overburden.

Another key feature of the present invention is that the hydrocarbon recovery mechanism is dominated by gravity drainage of the high temperature, mobilised oil into the completed production well. Gravity drainage is a well-known process for oil recovery and is the basis for the SAGD process. However, in the present invention, the gravity drainage is not carried out uniformly over the length of the horizontal sections of the completed injection and production wells. Instead, gravity drainage is targeted in those areas close to, or adjacent to, those with oxidant injection. Therefore, while gravity drainage is a key mechanism for oil recovery in the methods disclosed herein, it is not intended to be performed uniformly over the length of the completed horizontal wells. As such, the present invention does not try to create uniform profiles of injected or produced fluids over the length of the completed horizontal wells.

The present invention therefore differs markedly in approach to other methods which are aimed at achieving uniform distributions of fluids and/or pressure over the length of the horizontal, with devices such as inflow control devices (ICD). In the present invention, the non-uniform properties of the reservoir are managed by moving the location of the injected fluids in time, and producing from targeted zones that have been heated by the combustion processes resultant from oxidant injection. In this way, higher oil recovery rates can be achieved from the process conducted in a heterogeneous reservoir than via use of competing ISC methods, such as Fire Flood, THAI or CAGD.

Two key insights into the recovery mechanisms for heavy oil from combustion processes which have hitherto not been recognised and ensured by design in any of the prior proposed processes, such as Fire Flood, THAI and CAGD, are: 1) maintenance of minimum oxidant flux to ensure combustion in HTO (high temperature oxidation) mode, and 2) ability to recover hydrocarbons from heterogeneous hydrocarbon-bearing subterranean formations.

In THAI, the air is injected in a vertical well and so the air flux flowing through the reservoir is quickly diminished by the radial profile of the air flow around the injector. As the air moves away radially from the injector, the air flux diminishes inversely in proportion to the radial distance from the injector. In addition, reservoir heterogeneity means that some areas receive more air flux and others lower air flux than the average flux. Even when a line drive is attempted using multiple THAI well-pairs, reservoir heterogeneity means that preferential flow of the air occurs, and this reduces the effectiveness of the combustion process and its ability to mobilise oil to drain into the producer. Thus, reasonably spaced vertical injectors over a horizontal producer, as in the THAI or multi-THAI process, are not the most effective method for mobilising oil and producing it at economic rates.

Field results from the THAI process have been disappointing and economical rates of oil production have not been achieved in practice.

By using the concept of moving injection gravity drainage (MIGD), injecting the oxidant from discrete points along the completed horizontal well and enabling these points to be moved through the formation in time, the minimum oxidant flux to ensure efficient combustion in the HTO mode is readily achieved, and at the same time reservoir heterogeneity can be accommodated through operational changes to oxidant injection rates, oxidant/water injection ratios, and by moving the location of the oxidant injection location once all of the oil in a zone has been mobilised to the completed production well. Applying moving injection gravity drainage thereby leads to a much more efficient method of recovering in-situ hydrocarbons from the subterranean formation. This enables high oil production rates, lower air-oil-ratios (AOR) and high total oil recovery factors from a given formation than can be achieved by methods such as Fire Flood, THAI and CAGD as described in the prior-art.

DESCRIPTION OF EMBODIMENTS

Figure 1:
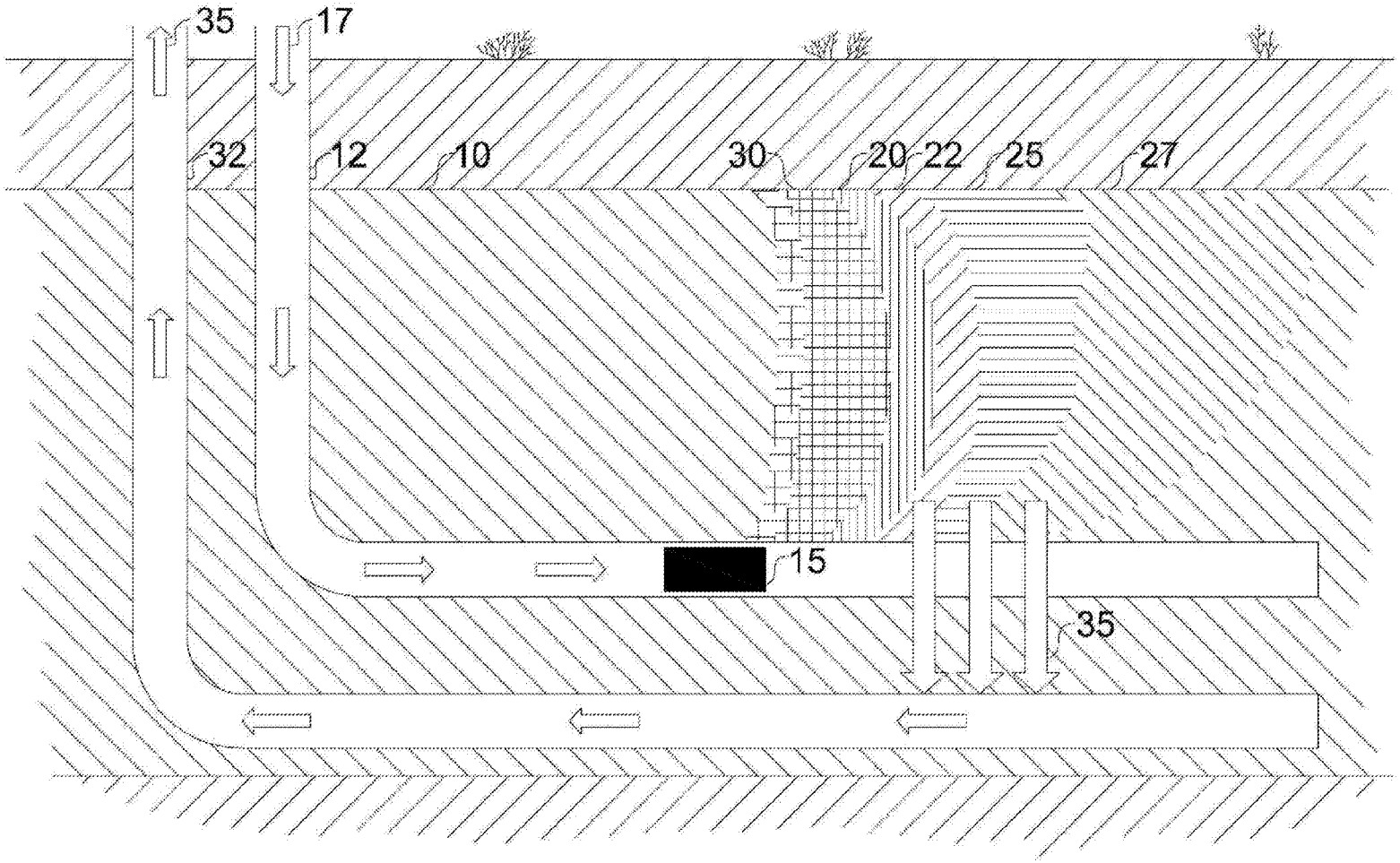
FIG. 1 is a side section view of a portion of hydrocarbon-bearing subterranean formation illustrating certain aspects of the present invention.

Throughout this specification, unless the context requires otherwise, the words "comprise"/"include", "comprises"/"includes" and "comprising"/"including" will be understood to mean the inclusion of a stated integer, group of integers, step, or steps, but not the exclusion of any other integer, group of integers, step, or steps.

The present invention relates to methods for the recovery of petroleum from subterranean formations, including, for example, heavy oil, oil sands, and bitumen reservoirs, mobilised via the combination of steam injection and combustion of in-situ hydrocarbons. These methods include accessing existing well-pairs in the subterranean formations (and completing the same if necessary), as well as providing completed well-pairs in the subterranean formations, and injecting steam, water, air, inert fluids (e.g., nitrogen), and quenching oil (including combinations thereof) into the wells via tubing strings positioned therein along with combustion of in-situ hydrocarbons to mobilise petroleum in the formations and recovery of the same.

Generally, in the methods disclosed herein, steam is first injected into a generally horizontal competed production well via a tubing string positioned therein to establish one or more connections between the completed production well and a generally horizontal competed injection well. This is followed by the injection of steam into the completed injection well via a tubing string positioned therein to pre-heat the well for ignition of in-situ hydrocarbons, followed by oxidant injection into the injection well via the tubing string to initiate combustion of the in-situ hydrocarbons at one or more locations within the formation, with concomitant mobilisation of petroleum in the formation towards the production well. Oxidant/water injection into the completed injection well via the tubing string follows, along with tubing retraction as desired (with an average retraction rate of 0.1 m/d), to move the one or more combustion zones and maintain petroleum mobilisation. During shut down, oxidant injection is stopped, and residual petroleum drains to the production well.

The term "well" refers to a hole drilled into a hydrocarbon-bearing subterranean formation/reservoir for use in the recovery of hydrocarbons. The term "well" is used interchangeably with "wellbore". Likewise, the terms "formation" and "reservoir" are used interchangeably.

As will be understood by one of ordinary skill in the art, while injection and production wells are described herein as being "generally horizontal" (or having "generally horizontal segments" or "generally horizontal leg portions"), the injection/production wells include substantially vertical sections from surface to a hydrocarbon-bearing subterranean formation of interest. That part of an injection/production well where the vertical section meets or joins the horizontal section/segment/leg portion is generally referred to as the "heel", and the end of the well (in the formation) as the "toe". As will be understood by one of ordinary skill in the art, the term "generally horizontal" (with reference to injection and production wells) includes angles from about 0 to 30 degrees relative to the horizontal direction, to facilitate recovery of mobilised petroleum.

As used herein, the phrase "subterranean" formation/reservoir refers to a collection or accumulation that exists below the surface of the earth, for example, under a sea or ocean bed. A hydrocarbon reservoir is therefore a mass of hydrocarbons that has accumulated in the porous strata existing below the earth's surface.

The term "completed", as in a "completed well-pair", "completed injection well", or "completed production well", is used herein to refer to a well that is fitted in the generally horizontal section of the well with a perforated/slotted liner conventional in the art. Preferably, the injection well is fitted with a perforated/slotted liner wherein the perforations are grouped together in one or more sections/regions along the length of the liner, alternating with non-perforated sections of the liner. In some embodiments, sections of the liner have no apertures, and flow restrictors (installed on the tubing string) are positioned on either side of the oxidant injection point(s) to allow the majority of the oxidant flow to enter the formation between the flow restrictors.

As used herein, the term "tubing string" includes both single and multiple string (e.g., dual) configurations conventional in the art, including dual configurations that are concentric arrangements (i.e., coil-within-coil design). The tubing strings can be configured for a single point injection at the distal tip of the string, or for multiple injection points along the length of the string, as will be understood by one of ordinary skill in the art.

The term "desired pressure", with reference to the pressure in an injection well and/or a production well, refers to a pressure appropriate for the geological and mechanical parameters of a hydrocarbon-bearing subterranean formation (including well-pairs) from which petroleum recovery is sought, as will be understood by one of ordinary skill in the art.

The well arrangements described herein in combination with steam injection and combustion of in-situ hydrocarbons facilitate the recovery of hydrocarbons, especially heavy hydrocarbons, from subterranean reservoirs.

Formations/well arrangements include, but are not limited to: (1) a formation intersected by a completed well-pair having a generally horizontal injection well and a generally horizontal production well (in one embodiment the injection well is positioned substantially directly above the production well, in another embodiment, the injection well is positioned substantially above the production well and offset laterally from it); (2) providing a generally horizontal completed injection well and a generally horizontal completed production well in a formation, where the injection well is positioned substantially above the production well (in one embodiment, the injection well is positioned substantially directly above the production well, in another embodiment, the injection well is positioned substantially above the production well and offset laterally from it); (3) a formation in fluid communication with a generally horizontal segment of a completed production well and a generally horizontal segment of a completed injection well, the horizontal segment of the injection well generally parallel to and substantially vertically spaced apart above the horizontal segment of the production well; and (4) providing a completed production well having a substantially vertical portion extending downwardly into a formation and having a generally horizontal leg portion in fluid communication with the vertical portion and extending generally horizontally outwardly therefrom, and providing a completed injection well having a substantially vertical portion extending downwardly into the formation and having a generally horizontal leg portion in fluid communication with the vertical portion and generally parallel to and substantially vertically spaced apart above the horizontal leg portion of the production well. A plurality of completed injection/production wells and/or well pairs may intersect/be provided to a hydrocarbon-bearing subterranean formation.

Preferably, the distance within a formation between a generally horizontal completed injection well (or generally horizontal completed segments/leg portions) and a generally horizontal completed production well (or generally horizontal completed segments/leg portions) is about 2-20 meters, more preferably about 5-10 meters.

In one embodiment, a wellhead of a generally horizontal completed injection well and a wellhead of a generally horizontal completed production well are located at opposite ends of a hydrocarbon-bearing subterranean formation. In another embodiment, injection and production wellheads are located at the same end of the formation.

In another embodiment, one or more service wells (typically, substantially vertical) intersect/are provided to a formation in addition to the completed injection/production well(s).

In a further embodiment, a generally horizontal completed production well can be configured to segregate gas and liquid flows such that hydrocarbons and water are carried by it and transported to the heel section from where they are transferred to surface, whereas non-condensable gas is vented (i.e., removed) via a separate connection to surface (e.g., via a service well).

The methods of the invention are based on steam heating of hydrocarbons present within a hydrocarbon-bearing subterranean formation, mobilising the same (with recovery), replacing steam with an oxidant once the auto-ignition temperature of in-situ hydrocarbons has been reached, thereby combusting a portion of the same, and mobilising additional hydrocarbons for recovery. Injection of the oxidant into the formation following the initial ignition of in-situ hydrocarbons allows for the establishment of a combustion front of ignited hydrocarbons in the formation, and the area of the formation adjacent to the combustion front is heated, resulting in the viscosity of any hydrocarbons present in the vicinity being reduced and mobilised. As the hydrocarbons soften and become less viscous, gravity forces them downwards towards a generally horizontal completed production well from where they can be produced at surface.

As will be understood by one of ordinary skill in the art, mobilised hydrocarbons (including mobilised petroleum) entering a generally horizontal completed production well can be conveyed to surface via any applicable method, such as pumping, artificial lift, and the like.

While injection of an oxidant within a generally horizontal completed injection well occurs at one or more given points along the length of a tubing string, the rate of oxidant injection can be increased from a minimum value to a maximum value, thereby providing an appropriate oxygen flux to the combustion front(s) as it progresses outwards around the completed injection well into a hydrocarbon-bearing subterranean formation. At a given location where oil recovery is being targeted, the rates of oxidant and water injection can be manipulated to accommodate changes in the properties of the reservoir to optimise the oil production, oil recovery factor, and oxidant-oil-ratio. For example, in regions with high permeability between the completed injection well and the completed production well (e.g., a fracture or high permeability zone), the oxidant injection rate may need to be reduced, in order to prevent breakthrough of the oxidant into the completed production well. For example, in regions with high oil and/or water saturation above the injector, the oxidant injection rate may be increased to ensure a good combustion and maintenance of the combustion in the HTO mode. Thus, by having discrete locations where the combustion process is occurring, the properties of the combustion process can be optimised for the local reservoir conditions in order to maximise the performance of the oil recovery process. This is not possible in processes which inject an oxidant at a fixed location, or in processes which try to distribute the oxidant uniformly over a horizontal well (e.g., of 500 to 1000 m in length), which will reasonably encounter significant changes in reservoir properties along its length.

As will be understood by one of ordinary skill in the art, steam, water, air, inert fluids (e.g., nitrogen), and quenching oil for delivery to a hydrocarbon-bearing subterranean formation as disclosed herein can be separately injected into the formation (via a tubing string positioned in a completed injection well and/or completed production well) in sequential, alternating, and/or repeating fashion, as well as simultaneously injected in one or more combinations. For example, where a coil-within-coil dual tubing string is used, one or more fluids can flow in the annulus between the two coils, while the inner coil transports one or more additional fluids. Additionally, a packer can be used where desired.

Having an ability to control temperatures achieved in a hydrocarbon-bearing subterranean formation by in-situ combustion of hydrocarbons is advantageous as it impacts upon the nature of the hydrocarbon (e.g., petroleum) mixture recovered in the process. Generally, the higher the temperature achieved by the combustion of hydrocarbons in the formation, the greater the amount of upgrading to the hydrocarbon mixture that occurs. As used herein, the term "upgrading" generally refers to the process of altering a hydrocarbon mixture to have more desirable properties (e.g., reducing the average molecular weight of the hydrocarbons present in the mixture and, correspondingly, its viscosity).

Upgrading during the recovery step is therefore generally desirable. In in-situ combustion processes, upgrading is believed to occur by thermal cracking. At the same time, however, the temperature of the reservoir needs to be controlled so that the combustion area, as well as the combustion gases, are contained in that part of the formation where they are desired. In the methods of the present invention, the combination of steam injection and the retracting process of oxidant injection with control of oxidant concentration and injection rates ensure that combustion is maintained at the desired temperature and in the correct areas of the reservoir.

The production well can be designed to aid in upgrading of hot heavy oil to an even better quality. Upgrading of the oil occurs due to maintenance of high temperatures, addition of hydrogen, and addition of catalysts in contact with the oil. Oil upgrading can be achieved by one or a combination of the following methods: (1) addition of heat in the production well, via fluid injection or electric heat elements; (2) addition of hydrogen, via fluid injection from surface; (3) addition of catalysts, via integration with the production well (i.e., catalysts can be embedded into the production well design, such as via coatings, sandwich of materials, etc.); and (4) addition of catalysts, via circulation from surface (i.e., catalysts are injected in a fluid stream and circulated back to surface).

In the figures, like reference numerals refer to like features.

Referring to FIG. 1, there is generally depicted a hydrocarbon-bearing subterranean formation 10 illustrating certain aspects of the invention. A generally horizontal injection well 12 is drilled into the formation 10 using standard directional drilling techniques. The location of an oxidant injection device 15 can be moved through the formation 10 from the toe of the injection well 12 back to the heel of the injection well 12, or vice versa, as well as swept through the formation 10 from toe-to-heel (or heel-to-toe) of the injection well 12. The process of moving the oxidant injection device 15 addresses issues associated with maintaining oxidant flux, to ensure high temperature oxidation, matching oxidant injection to active combustion zone size, and being able to move the oxidant location, so as to mobilise the maximum amount of hydrocarbons and minimise the impacts of reservoir heterogeneity.

The injection of oxidant 17 creates a number of zones in the formation 10. The oxidant will react with hydrocarbons in the formation 10 to form a high temperature combustion zone 20 (circa 500 to 900° C.). The combustion zone 20 is the main energy generation region, in which injected oxidant reacts with hydrocarbons to produce carbon oxides and water. Temperature levels in this relatively narrow region are largely determined by the amount of fuel consumed per unit volume of reservoir rock.

In front of the combustion zone 20, temperatures are more moderate, but sufficient to enable cracking of hydrocarbons and depositing coke on the reservoir rocks in a thermal cracking zone 22. With oxidant removed in the combustion zone 20, hydrocarbons contacted by the leading edge of the high-temperature region undergo thermal cracking and vaporisation. The mobilised light ends are transported downstream and are mixed with native crude. The heavy residue, nominally defined as coke, is deposited on the core matrix and is the main fuel source for the combustion process. The thermal cracking zone 22 will have a temperature of between about 300 to 600° C.

Further in front of the thermal cracking zone 22, water in the reservoir is heated to form saturated and superheated steam at temperatures below about 300° C., creating a steam zone 25. Connate water and water of combustion move ahead of the high-temperature region. The temperature in the steam zone 25 is dictated by the operating pressure and the concentration of combustion gases.

Still further ahead, high temperatures from the steam conduct heat into the reservoir heating and mobilising petroleum in a hot zone 27. The leading edge of the steam bank is the primary area of petroleum mobilisation. Only residual oil remaining behind the condensation front and steam bank undergoes vaporization and thermal cracking.

A burned zone 30 (i.e., a region that has been swept by the combustion zone 20), is also created by the injection of oxidant. The temperature in the burned zone 30 increases in the direction of the combustion front, and a significant proportion of the generated energy either remains in this region or is lost in the surrounding strata. Under efficient high-temperature burning conditions, this area is essentially devoid of fuel.

A generally horizontal production well 32 is drilled in the formation 10 (using standard directional drilling techniques) below the injection well 12, typically between 4 and 8 meters below the injection well 12. Heated (i.e., mobilised) petroleum from the thermal cracking zone 22, steam zone 25, and hot zone 27 then drains into the production well 32 under the combined effects of temperature due to combustion/gasification and gravity. The condensation of hot steam vapours is a key region where petroleum is heated and mobilised to drain into the production well 32. Oil 35 from the production well 32 is then lifted to surface by a combination of pumping and gas lift, as required.

Figure 2:
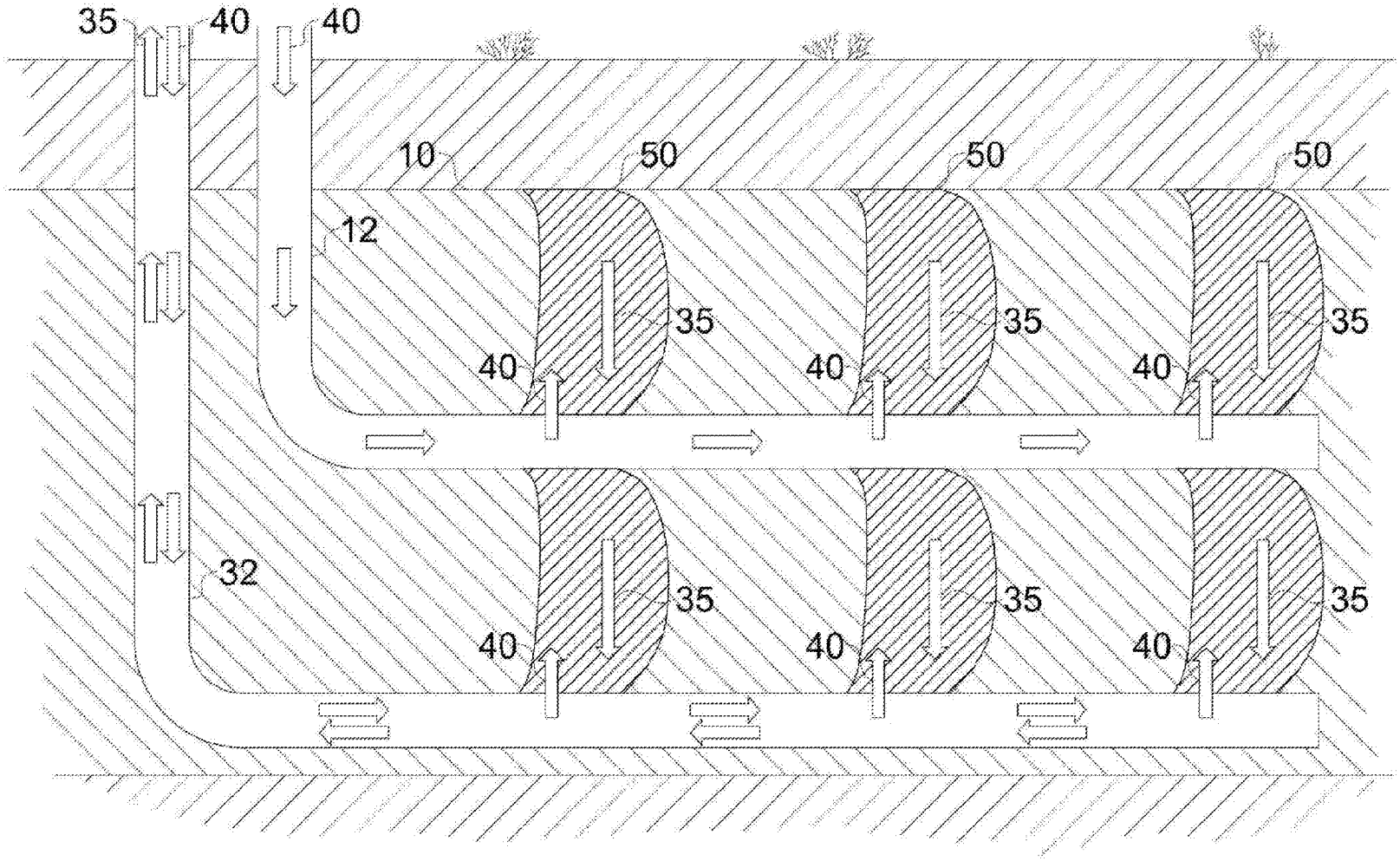
FIG. 2 is a side section view of a portion of a hydrocarbon-bearing subterranean formation illustrating the establishment of multiple (i.e., three) connections between a completed production well and a completed injection well that intersect the formation, along with drainage of mobilised petroleum to the production well. Multiple steam injection points (via a tubing string positioned in the production well) are used to establish the connections.

Referring to FIG. 2, there is generally depicted a hydrocarbon-bearing subterranean formation 10 illustrating certain aspects of the invention. Steam 40 is injected into the formation 10 via a tubing string positioned in an injection well 12 and/or a tubing string positioned in a production well 32 to establish connections between the injection well 12 and the production well 32. In some embodiments, steam 40 injected into the formation 10 via the tubing string positioned in the injection well 12 is recirculated to surface. Steam 40 enters zone 50, and heated (i.e., mobilised) petroleum then drains into the production well 32 under the combined effects of temperature due to steam 40 and gravity. Oil 35 from the production well 32 is then lifted to surface by a combination of pumping and gas lift, as required.

Figure 3:
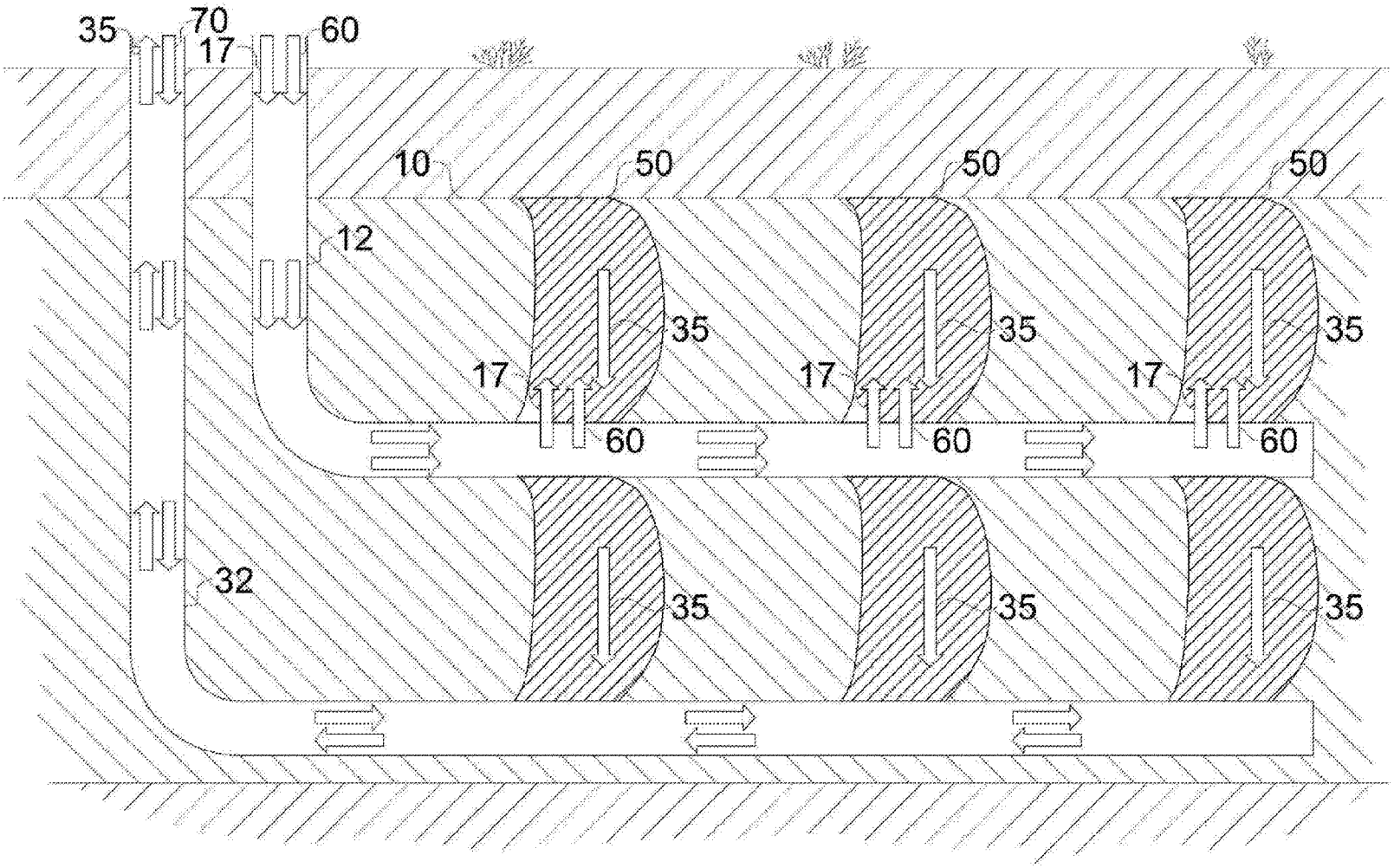
FIG. 3 is a side section view of a portion of a hydrocarbon-bearing subterranean formation illustrating initiation of combustion of in-situ hydrocarbons at multiple (i.e., three) locations within the formation, along with drainage of mobilised petroleum to a completed production well. Multiple air injection points (via a tubing string positioned in the injection well) are used to initiate combustion.

Referring to FIG. 3, there is generally depicted a hydrocarbon-bearing subterranean formation 10 illustrating certain aspects of the invention. Three oxidant 17 injection points (via a tubing string positioned in an injection well 12) are used to initiate combustion of hydrocarbons in the formation 10 in zone 50 (which includes zones 20, 22, 25, 27, and 30). Water 60 is optionally injected into the formation 10 via the tubing string positioned in the injection well 12. Heated (i.e., mobilised) petroleum from zone 50 then drains into the production well 32 under the combined effects of temperature due to combustion/gasification and gravity. Oil 35 from the production well 32 is then lifted to surface by a combination of pumping and gas lift, as required. A quench fluid 70 is optionally injected into the formation 10 via the tubing string positioned in the production well 32.

Figure 4:
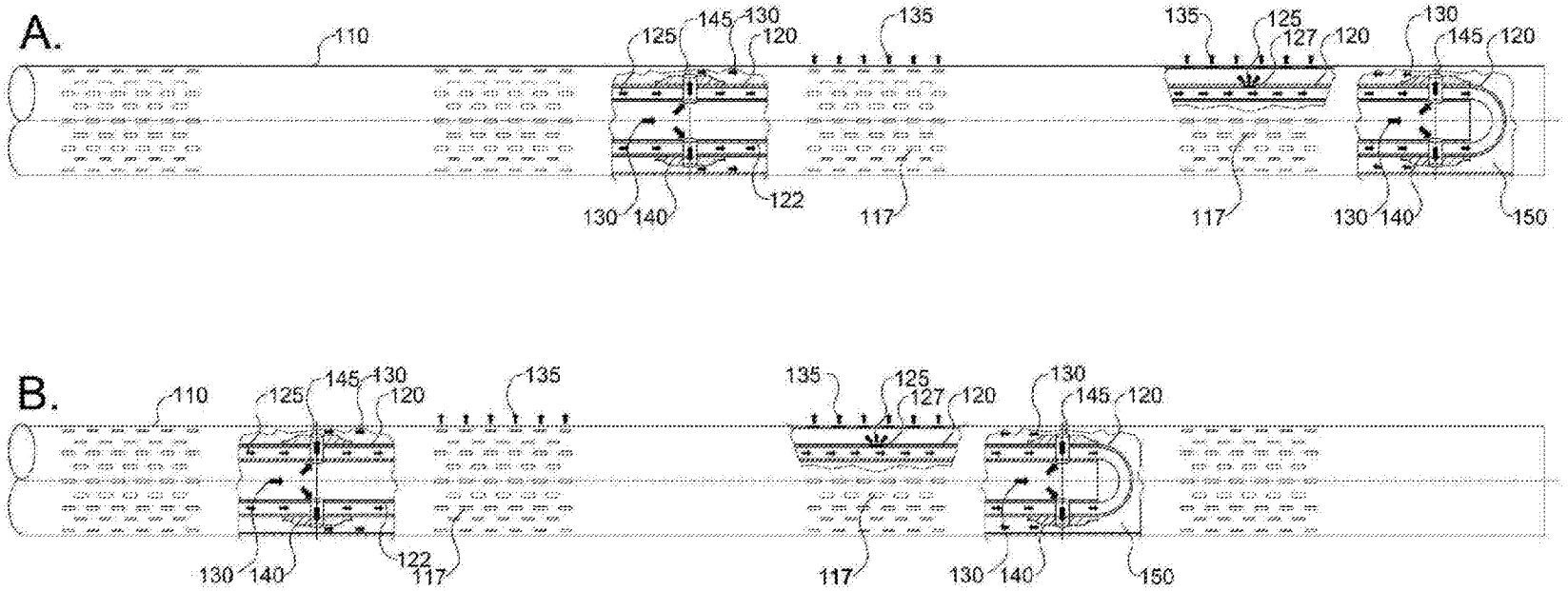
FIG. 4 illustrates an embodiment of the invention wherein an injection well is configured for single point injection.

Referring to FIG. 4, which shows an embodiment for the well completion for the injection well with a single injection point, there is a horizontal well liner 110, with a typical outer diameter of 7 inches, with a plurality of apertures spaced along its length. An outer tubing string 120 is positioned within the well liner 110, comprising an inner tubing string 122 and a cuff/sealing arrangement 140. Typically the outer tubing string 120 has an outer diameter of 4.5 inches and the inner tubing string 122 has an outer diameter of 2.5 inches. Steam and/or oxidant 125 is injected into the annulus between the outer tubing string 120 and inner tubing string 122, and is injected into the annular space 150 between the well liner 110 and the outer tubing string 120 through apertures 127 in the outer tubing string 120 located between the cuffs/seals 140. Steam and/or water 130 is optionally injected into the inner tubing string 122 and is transported to the periphery of the outer tubing string 120 via conduits 145. The steam and/or water 130 help to provide a back pressure reducing the transport of the oxidant 125 past the cuffs/seals 140. The steam and/or water 130 also helps to maintain the temperature of the well within acceptable limits to ensure mechanical integrity of the well liner 110. The steam and/or oxidant 125 and the steam and/or water 130 mix within the annulus 150, forming an oxidant mixture 135 which passes through the perforations 117 located in the well liner 110 between the pairs of cuffs/seals 140 on the outer tubing string 120. Typically there would be two or more sets of perforations 117 located between each pair of cuffs/seals 140 and through which the oxidant mixture 135 passes (e.g., as illustrated in FIG. 4A). By moving the outer tubing string 120 within the well liner 110, the perforations 117 which actively inject the oxidant mixture 135 into the reservoir can be controlled. Generally, each individual movement of the outer tubing string 120 along the horizontal well, will be equal to the distance between one set of perforations 117, such that there is an overlap of oxidant mixture 135 injection into the reservoir (e.g., as illustrated by comparing FIG. 4A with FIG. 4B). This overlap ensures that hot mobile oil from the formation is always present in the vicinity of the perforations 117 used for oxidant 135 injection and so ensures that the combustion zone is always supplied with oxidant and is not at risk of being extinguished. By periodically moving the outer tubing string 120 along the horizontal well liner 110, the combustion front can sweep through the entire oil reservoir and thereby all of the oil in the formation in the vicinity of the injection and production wells can be produced to surface via the production well.

Figure 5:
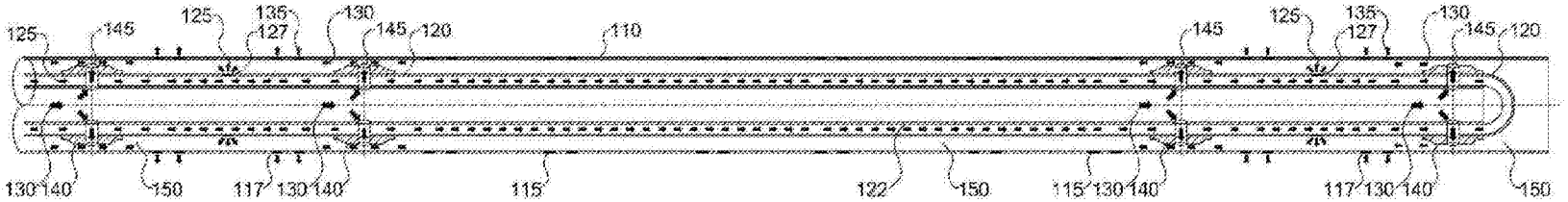
FIG. 5 illustrates an embodiment of the invention wherein an injection well is configured for multi-point injection (two are illustrated by way of example).

Referring to FIG. 5, there is an embodiment for the well completion for the injection well showing two injection zones into the reservoir and illustrating certain aspects of the invention. The number of injection zones may be varied as required for each particular design and does not limit the invention. A horizontal well liner 110, with a typical outer diameter of 7 inches, exists with a plurality of perforations 115 spaced along its length. An outer tubing string 120 is positioned within the well liner 110, comprising an inner tubing string 122 and a cuff/sealing arrangement 140. Steam and/or oxidant 125 is injected into the annulus between the outer tubing string 120 and inner tubing string 122, and is injected into the annular space 150 between the well liner 110 and the outer tubing string 120 through apertures 127 in the outer tubing string 120 located between the cuffs/seals 140. Apertures 127 are located between pairs of cuffs/seals 140 on the outer tubing string 120, and there can be multiple pairs of cuffs/seals 140 on the outer tubing string 120. The outer tubing string 120 is positioned such that the cuffs/seals 140 align with the non-perforated sections of the well linear 110. Steam and/or water 130 is optionally injected into the inner tubing string 122 and is transported to the periphery of the outer tubing string 120 via conduits 145. The steam and/or water 130 helps to provide a back pressure reducing the transport of the oxidant 125 past the cuffs/seals 140. The steam and/or water 130 also helps to maintain the temperature of the well liner 110 within acceptable limits to ensure mechanical integrity. The steam and/or oxidant 125 and the steam and/or water 130 mix within the annulus 150, forming an oxidant mixture 135 which passes through the perforations 117 located in the well liner 110 between the cuffs/seals 140 on the outer tubing string 120. Typically there would be two or more sets of perforations 117 located between each set of cuffs/seals 140 and through which the oxidant mixture 135 passes. By moving the outer tubing string 120 within the well liner 110, the perforations 117 which actively inject the oxidant mixture 135 into the reservoir can be controlled. Generally, each individual movement of the outer tubing string 120 along the horizontal well, will be equal to the distance between one set of perforations 117, such that there is an overlap of oxidant mixture 135 injection into the reservoir.

Figure 6:
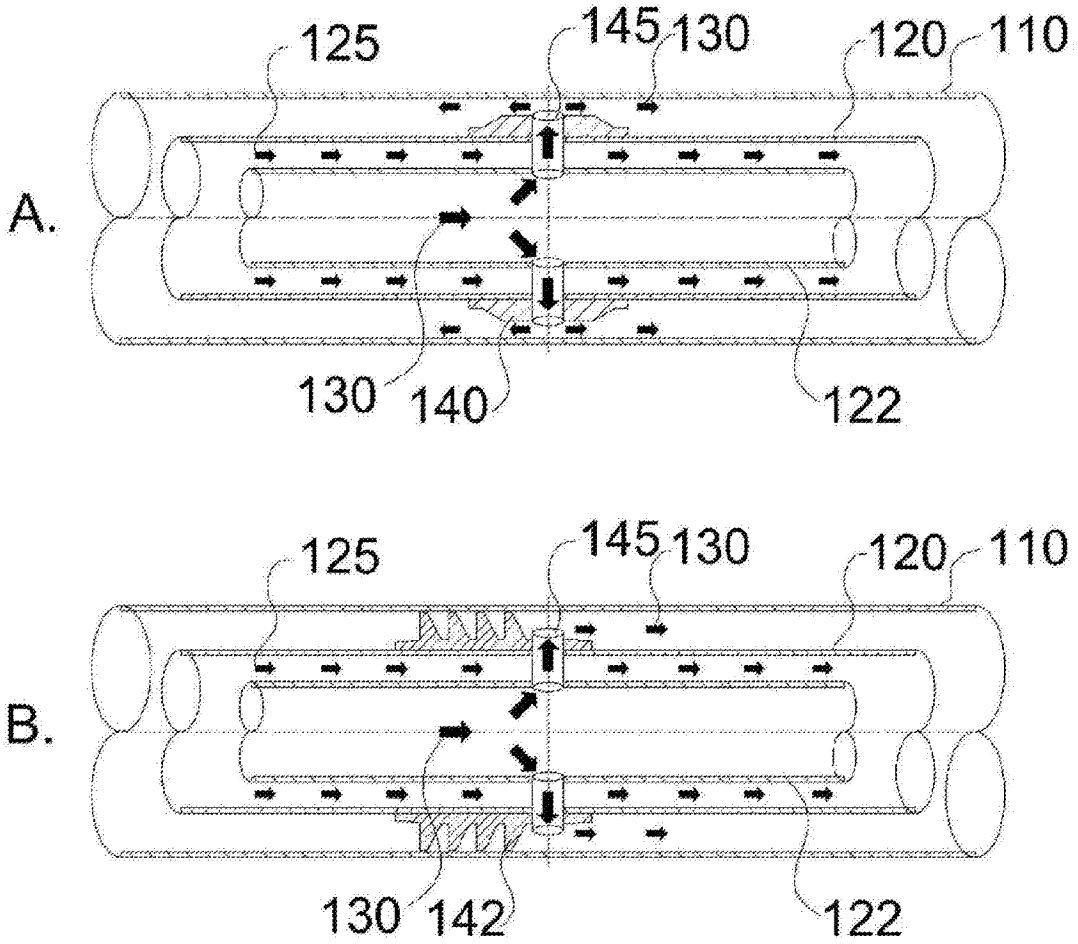
FIG. 6 illustrates two embodiments of sealing arrangements for a completed injection well comprising a tubing string.

Referring to FIG. 6, illustrated are embodiments of the sealing arrangements between the outer tubing string and the well liner. FIG. 6A illustrates an embodiment for the sealing arrangement wherein a cuff 140 is placed on an outer tubing string 120. The cuff 140 serves to centre the tubing string within the well liner 110 and to reduce the clearance between the tubing string and the well liner. In addition a conduit 145 is embedded into the cuff 140 wherein water and/or steam 130 is transported from the inner tubing string 122 to the annulus between the outer tubing string 120 and the well liner 110. The water and/or steam 130 provide a fluid blanket at higher pressure than the surroundings, reducing the degree to which other fluids can flow of diffuse past the cuff 140. The water and/or steam 130 also acts to cool the well liner 110, thereby ensuring that the temperature of the liner is maintained within limits for mechanical integrity. Oxidant 125 is conveyed with the annulus between the inner and outer tubing strings along the tubing string.

FIG. 6B illustrates an embodiment for the sealing arrangement wherein a packer 142 is placed on an outer tubing string 120. The packer 142 may be made of any suitable material and provides a direct contact with the well liner 110. The packer design can include incorporation of "wiper blades" that are flexible and seal any clearances between the well liner 110 and outer tubing string 120. In addition the packer 142 may include elements made of metal and other materials which provide a seal against the inner diameter of the well liner 110, while still enabling the outer tubing string 120 to be moved periodically along the length of the horizontal well liner 110. In addition a conduit 145 is embedded into the packer 142 wherein water and/or steam 130 is transported from the inner tubing string 122 to the annulus between the outer tubing string 120 and the well liner 110. The water and/or steam 130 provides a fluid blanket at higher pressure than the surroundings and acts to cool the well liner 110, thereby ensuring that the temperature of the liner is maintained within limits for mechanical integrity. Oxidant 125 is conveyed with the annulus between the inner and outer tubing strings along the tubing string.

EXAMPLES

The present invention is described in the following non-limiting Examples, which set forth to illustrate and to aid in an understanding of the invention, and should not be construed to limit in any way the scope of the invention.

The Examples have been prepared using extensive computer simulations of the recovery process using the STARS™ Thermal Simulator general issue 2013 and 2014, provided by Computer Modelling Group of Calgary, Alberta, Canada.

The simulations have been made with a set of simplified components, and reaction to represent the key features of the combustion of heavy oil. In the simulations the heavy oil is modelled as being composed of the pseudo-components: maltenes and asphaltenes. The reaction scheme and stoichiometric parameters are provided in Table 1 and are derived from the work of Belgrave et al. (J. D. M. Belgrave, R. G. Moore, M. G. Ursenbach and D. W. Bennion, "Comprehensive Approach to In-Situ Combustion Modeling", Society of Petroleum Engineers, SPE Paper 20250, 1990). Table 2 provides the kinetic parameters for each reaction assuming a first order reaction rate, $r=A \exp(-E/RT)\, C$, where A is the pre-exponential factor (variable units), E is the activation energy (J/mol), R is the gas constant ($=8.314\times 10^3$ J/mol-K) and T is the temperature (K) and C is the concentration of the reactant.

Table 3 provides parameters for the reservoir.

TABLE 1

Reaction Scheme and Stoichiometry for Heavy Oil Combustion

| Reaction | Reaction Description | Stoichiometry |
|---|---|---|
| 1 | Thermal cracking | Maltenes → 0.372 Asphaltenes |
| 2 | Thermal cracking | Asphaltenes → 83.206 Coke |
| 3 | Low Temperature Oxidation | Maltenes + 3.431 O2 → 0.4737 Asphaltenes |
| 4 | Low Temperature Oxidation | Asphaltenes + 7.513 O2 → 101.559 Coke |
| 5 | High Temperature Oxidation | Coke + 1.230 O2 → 0.8968 CO2 + 0.1 N2_CO + 0.565 H2O |

TABLE 2

Reaction Kinetics for Heavy Oil Combustion

| Reaction | Pre-Exponential Factor A | Units | Activation Energy E (J/mol) | Heat of Reaction (J/mol) |
|---|---|---|---|---|
| 1 | $4.05 \times 10^{10}$ | $day^{-1}$ | $1.16 \times 10^6$ | 0 |
| 2 | $1.82 \times 10^4$ | $day^{-1}$ | $4.02 \times 10^4$ | 0 |
| 3 | $2.12 \times 10^5$ | $day^{-1}\ kPa^{-0.4246}$ | $4.61 \times 10^4$ | $1.30 \times 10^6$ |
| 4 | $1.09 \times 10^5$ | $day^{-1}\ kPa^{-4.7627}$ | $3.31 \times 10^4$ | $2.86 \times 10^6$ |
| 5 | $3.88 \times 10^0$ | $day^{-1}\ kPa^{-1}$ | $8.21 \times 10^2$ | $4.95 \times 10^5$ |

TABLE 3

| Reservoir Parameters | | |
|---|---|---|
| Parameter | Units | Value |
| Porosity | % | 32 |
| Permeability lateral (X, Y) | mD | 4000 |
| Permeability vertical (Z), assumed 75% of lateral permeability | mD | 3000 |
| Reservoir Temperature | ° C. | 29 |
| Reservoir Pressure | kPag | 3750 |
| Oil gravity @ 15.6° C. | API | 10.5 |
| Oil density | kg/m$^3$ | 996.5 |
| Oil viscosity at 20° C. | cP | 49302 |
| Oil saturation | % | 80 |
| Water saturation | % | 20 |
| Assumed auto-ignition temperature | ° C. | >180 |

Example 1: Heterogeneous Reservoir Simulations

The rate of heavy oil production and cumulative oil recovery using a method for recovering petroleum from a hydrocarbon-bearing subterranean formation in accordance with an embodiment of the invention has been modeled in computer simulations and compared/contrasted with the THAI and CAGD processes in a three dimensional model of a Kerrobert oil sands formation with reservoir dimensions of 250 meters by 30 meters by 30 meters, with 5 meter grid blocks. Model parameters are shown in Table 4, below.

In this Example, the MIGD process is simulated with a single injection point in the horizontal injection well, which is swept through the oil reservoir.

Reservoir heterogeneity is modelled by randomly assigning a porosity of between 10% and 70% to each grid block cell, while keeping the average reservoir porosity of 32%. The distribution of porosity in the reservoir is not a normal distribution and has a longer tail of smaller porosities than given by the normal distribution. The permeability of each grid block cell is then calculated as a function of the porosity using the formula: k=24,965×(0.1+porosity)^3/((1.0−porosity)^2).

TABLE 4

| Computer simulation parameters | | |
|---|---|---|
| Parameter | Units | Value |
| Top of oil reservoir | m | 760 |
| Bottom of oil reservoir | m | 790 |
| Oil reservoir thickness | m | 30 |
| Top of oil reservoir pressure | KPag | 3,750 |
| Bottom of oil reservoir pressure | KPag | 4,043 |
| Production well, height above bottom of reservoir | m | 1 |
| Injection well, height above production well | m | 14 |
| Production well horizontal length | m | 240 |
| Injection well horizontal length | m | 240 |
| Oxidant | — | Air |
| Oxidant injection rate | Sm3/day | 8,500 |
| Oxidant retraction rate | m/day | 0.05 |
| Oxidant injection temperature | ° C. | 25 |
| Initial oxidant injection pressure | KPag | 20,000 |

In the heterogeneous reservoir simulations described above, oil production rates were circa 25 bpd/well for both the THAI and CAGD processes, while the MIGD process had oil production rates of circa 75 bpd/well. Additionally, unlike the THAI and CAGD processes, where air broke through to the production well, air did not breakthrough to the production well in the MIGD process.

Over a simulated nine year period, MIGD's cyclic sweep along the horizontal portion of the injection well boosted cumulative recovery of heavy oil at greater efficiency than both THAI and CAGD. As seen in Table 5 below, cumulative resource recovery using the MIGD process is significantly better than either the THAI or CAGD processes. Additionally, the efficiency of MIGD, as evidenced by the air-oil-ratio (AOR), is superior to both THAI and CAGD (i.e., AOR is maintained below 3,000 m3/m3 for at least eight years with MIGD).

The low oil production rates and the high AORs simulated for the THAI process in a heterogeneous reservoir are consistent with field performance achieved at the Whitesands Pilot Project in Alberta and the Kerrobert Demonstration Project in Saskatchewan (see Petrobank Energy and Resources, "2011 Confidential Performance Presentation Whitesands Pilot Project", Annual report to Alberta Energy Regulator, April 2012, https://www.aer.ca/documents/oil-sands/insitu-presentations/2012AthabascaPetrobankWhitesands9770.pdf). The results highlight that the THAI process and the CAGD process do not perform well in "real world" heterogeneous reservoirs.

TABLE 5

| Heterogeneous reservoir simulations: Comparison of MIGD with THAI and CAGD | | | | | | |
|---|---|---|---|---|---|---|
| Time | Cumulative Oil Recovery (m3) | | | Air-Oil-Ratio (m3/m3) | | |
| (year) | MIGD | THAI | CAGD | MIGD | THAI | CAGD |
| 1 | 1,250 | 2,300 | 3,900 | 2,500 | 12,400 | 4,900 |
| 2 | 2,500 | 2,600 | 4,950 | 2,200 | 11,250 | 10,800 |
| 3 | 4,900 | 3,900 | 6,000 | 1,900 | 13,800 | 15,500 |
| 4 | 7,100 | 4,600 | 6,200 | 1,600 | 17,400 | 13,000 |
| 5 | 9,000 | 4,900 | 7,250 | 1,300 | 24,000 | 6,500 |
| 6 | 12,000 | ND | ND | 1,300 | ND | ND |
| 7 | 14,000 | ND | ND | 1,400 | ND | ND |
| 8 | 16,250 | ND | ND | 2,500 | ND | ND |
| 9 | 17,000 | ND | ND | 4,800 | ND | ND |

ND: not determined (i.e., simulations with THAI and CAGD were halted when AOR ratios were consistently higher than economically viable).

Example 2: Multi-Point MIGD Simulations

A detailed simulation of the invention has been performed to demonstrate the effectiveness of the technique for multi-point air injection, to achieve higher oil production per injection/production well pair. The simulation uses three injection points on the horizontal well by way of demonstration, however it is understood that more or less points can be utilised with the present invention.

Table 6 provides the geometrical parameters of the selected reservoir, while Table 7 provides the physical parameters. For simulation, the reservoir properties were considered to be homogeneous.

The simulations were conducted using grid blocks of size 1 meter height, 2 meters width and 2 meters length. Earlier sensitivity studies (not reported) showed that these grid block sizes provided the best compromise between computational speed and model resolution for this Example.

TABLE 6

| Reservoir Geometrical Parameters | | |
|---|---|---|
| Parameter | Units | Value |
| TVD to top of oil pay | m | 760 |
| Oil pay thickness/height | m | 15 |

TABLE 6-continued

| Reservoir Geometrical Parameters | | |
|---|---|---|
| Parameter | Units | Value |
| Oil pay width for half symmetry along horizontal wells' centreline | m | 30 |
| Oil pay length, including additional 10 m on either side | m | 620 |
| Oil pay dip/angle from horizontal | deg | 0 |

The injection well horizontal completion dimensions are provided in Table 6 and were modelled using the FLEX-WELL features of the STARS™ software. In the simulation model, the tubular dimensions for the concentrically orientated tubings were modelled using equivalent diameters within the simulator. The production well horizontal completion dimensions are provided in Table 7.

TABLE 7

| Injection well horizontal completion dimensions | | | | |
|---|---|---|---|---|
| | Slotted Liner | | Outer Air/Steam Tubing & Inner Steam/Water Tubing | |
| Parameter | [inches] | [m] | [inches] | [m] |
| OD Outer Tubing | 7.000 | 0.1778 | 4.500 | 0.1143 |
| ID Outer Tubing | 6.276 | 0.1594 | 3.941 | 0.1001 |
| WT Outer Tubing | 0.362 | 0.0092 | 0.280 | 0.0071 |
| OD Inner Tubing | — | — | 2.500 | 0.0635 |
| ID Inner Tubing | — | — | 2.067 | 0.0525 |
| WT Inner Tubing | — | — | 0.217 | 0.0055 |
| Weight [lb/ft or kg/m] | 26.0 | 38.69 | 11.600 | 17.26 |
| Length in horizontal | 600 | | 600 | |
| Slotted open area | 1.5% | | N/A | N/A |
| Slotted pattern | Slots, Apertures or Mesh | | N/A | N/A |

TABLE 8

| Production well horizontal completion dimensions | | | | |
|---|---|---|---|---|
| | Slotted Liner | | Steam tubing | |
| Parameter | [inches] | [m] | [inches] | [m] |
| OD | 9.625 | 0.2445 | 4.500 | 0.1143 |
| ID | 8.755 | 0.2224 | 4.026 | 0.10226 |
| WT | 0.435 | 0.0111 | 0.237 | 0.0060 |
| Weight [lb/ft or kg/m] | 43.50 | 64.74 | 11.00 | 16.37 |
| Length | 600 | | 600 | |
| Slotted open area | 1.5% | | N/A | N/A |
| Slotted pattern | Slots, Apertures or Mesh | | N/A | N/A |

In the present simulation example, three injection points are modelled along a horizontal length of 600 m. It is recognised that the number of injection points per horizontal well can be higher or lower than three, depending upon various factors in the present invention. It is anticipated that multiple-points would be used in commercial implementations with a spacing between the points of between 100 to 300 meters, and typically around 150 to 200 meters. Thus in a typical 1000 meters long horizontal injection well completed in the reservoir, the number of discrete injection points would be between three and ten, and typically around five. Similarly, for a 600 m long horizontal as modelled in this example, the number of discrete injection points will typically be three.

During the start-up of the MIGD process, the oil between the injection well and production well must be heated and mobilised before injection of air and combustion of part of the oil reservoir can be commenced. Steam is used to develop the heated and mobilised oil link between the two wells. Steam is circulated in the injection well by injecting it into the 2.5" OD and 4.5" OD concentric tubing and circulating it back to the heel of the injection well. Steam is circulated in the production well by injecting it into the 4.5" OD tubing and circulating it back to the heel of the production well. Table 8 shows the operational parameters utilised to create the mobilised oil zone between the injection and production wells.

TABLE 8

| Operational parameters for the steam injection phase | | |
|---|---|---|
| Parameter | Units | Value |
| Injection well steam linking method: Steam circulation | | |
| Total steam flow rate in annular flow path between 2.5" OD and 4.5" OD concentric dual RC tubing | $m^3/d$ | 90 |
| Total steam flow rate in small 2.5" OD tubing - not used | $m^3/d$ | 0 |
| Annulus between liner and tubing BHP | kPag | 4,000 |
| Maximum steam injection pressure | kPag | 4,500 |
| Production well steam linking method: Steam circulation | | |
| Total steam flow rate in 4.5" OD tubing | $m^3/d$ | 357 |
| Annulus between liner and tubing BHP | kPag | 3,500 |
| Maximum steam injection pressure | kPag | 4,800 |
| Perform steam linking until the following conditions reached | | |
| Reservoir oil saturation between injection and production horizontal | % | 55-60% |
| Injection well horizontal temperature profile around well, at ignition/air injection locations, to be ready for ignition | ° C. | >180 |

Results from the simulation of the amount of steam injected and the amount of oil produced during the steam injection phase is shown in Table 9. The steam linking phase requires 6 months for the example provided, with the steam linking time depending strongly on the distance between the injection and production well. Maximum oil production from the production well during the steam injection phase is estimated to be 225 bpd (circa 0.375 bpd/m of reservoir horizontal pay zone).

TABLE 9

| Production performance during the steam injection phase | | | | | | | |
|---|---|---|---|---|---|---|---|
| | Days per | Steam Injection | Oil Production | | | Water Production | SOR |
| Month | Month | [$m^3/d$] | [$m^3/d$] | [bbl/d] | [bbl] | [$m^3/d$] | [$m^3/m^3$] |
| 1 | 31 | 30 | 4.0 | 25 | 775 | 30 | 7.5 |
| 2 | 28 | 225 | 26.2 | 165 | 4,620 | 225 | 8.6 |
| 3 | 31 | 446 | 26.2 | 165 | 5,115 | 438 | 17.0 |
| 4 | 30 | 446 | 35.8 | 225 | 6,750 | 434 | 12.5 |
| 5 | 31 | 446 | 28.6 | 180 | 5,580 | 440 | 15.6 |
| 6 | 30 | 446 | 22.3 | 140 | 4,200 | 444 | 20.0 |

Once mobilisation of the oil between the injection and production wells has occurred and the temperature of the oil around the injection well is greater than the auto-ignition temperature of the oil (circa 180° C.) the process is ready for the injection of air. Table 10 shows the operational parameters for air injection operation. The nominal air injection rate is 24,000 $Sm^3/d$ (8,000 $Sm^3/d$ per injection point). The concentric tubing string in the injection well is retracted 6 m at a time, every 60 days giving an average retraction rate of 0.1 m/d.

TABLE 10

| Operational parameters for the air injection phase | | |
|---|---|---|
| Parameter | Units | Value |
| Total air injection flow ramp up to pre-determined optimum | $Sm^3/d$ | 24,000 |
| Air retraction rate | m/d | 0.1 |
| Total Injection well water injection rate for base case | $m^3/d$ | 0 |
| Production well quench oil injection rate | $m^3/d$ | 0 |

Air injection is started in Month 7 and is ramped up to 24,000 $Nm^3/d$ over 3 months in order to minimise the breakthrough of oxygen into the production well. The simulation is then run to Month 72 with a constant air injection rate of 24,000 $Sm^3/d$. Table 11 shows the results of the air injection phase of the MIGD process.

Oil production ramps up to over 350 bpd upon the commencement of air injection and then slowly declines as the size of the combustion zones increases and more and more heat is lost to the surrounding rocks; thereby decreasing the efficiency of the process. Nonetheless, the air oil ratio (AOR) is forecast to be below 2,500 $m^3/m^3$ for the life of the well, thereby demonstrating high efficiency in the use of the air when compared with other techniques, such as THAI and CAGD (see Example 1).

In practical operations, the process can be continued until the AOR increases to an unacceptably high level or when air breaks through into the production well making the process unmanageable. The rate of air injection could also be increased towards the end of life of the well, in order to reduce the decline rate of oil production and reduce the AOR.

The cumulative oil produced and combusted as a percentage of the original oil in place is calculated to be over 60% for Example 3.

TABLE 11

| Oil production performance during the air injection phase | | | | | | | | | |
|---|---|---|---|---|---|---|---|---|---|
| | Days per | Air Injection | | Oil Production | | | Off Gas Production | Water Production | AOR |
| Month | Month | [$Sm^3/d$] | [$Sm^3$] | [$m^3/d$] | [bbl/d] | [bbl] | [$m^3/d$] | [$m^3/d$] | [$Sm^3/m^3$] |
| 7 | 31 | 8,000 | 248,000 | 55.6 | 350 | 10,850 | 7,333 | 20 | 144 |
| 8 | 31 | 16,000 | 496,000 | 46.1 | 290 | 8,990 | 14,667 | 5 | 347 |
| 9 | 30 | 24,000 | 720,000 | 44.5 | 280 | 8,400 | 22,000 | 5 | 539 |
| 10 | 31 | 24,000 | 744,000 | 43.7 | 275 | 8,525 | 23,000 | 5 | 549 |
| 11 | 30 | 24,000 | 720,000 | 39.7 | 250 | 7,500 | 24,000 | 5 | 604 |
| 12 | 31 | 24,000 | 744,000 | 37.4 | 235 | 7,285 | 23,000 | 5 | 642 |
| 13 | 31 | 24,000 | 744,000 | 35.8 | 225 | 6,975 | 22,000 | 5 | 671 |
| 14 | 29 | 24,000 | 696,000 | 35.0 | 220 | 6,380 | 22,000 | 5 | 686 |
| 15 | 31 | 24,000 | 744,000 | 35.0 | 220 | 6,820 | 22,000 | 5 | 686 |
| 16 | 30 | 24,000 | 720,000 | 34.2 | 215 | 6,450 | 22,000 | 5 | 702 |
| 17 | 31 | 24,000 | 744,000 | 34.2 | 215 | 6,665 | 22,000 | 5 | 702 |
| 18 | 30 | 24,000 | 720,000 | 35.0 | 220 | 6,600 | 22,000 | 5 | 686 |
| 19 | 31 | 24,000 | 744,000 | 35.0 | 220 | 6,820 | 22,000 | 5 | 686 |
| 20 | 31 | 24,000 | 744,000 | 35.8 | 225 | 6,975 | 22,000 | 5 | 671 |
| 21 | 30 | 24,000 | 720,000 | 36.6 | 230 | 6,900 | 22,000 | 5 | 656 |
| 22 | 31 | 24,000 | 744,000 | 35.8 | 225 | 6,975 | 22,000 | 5 | 671 |
| 23 | 30 | 24,000 | 720,000 | 36.6 | 230 | 6,900 | 22,000 | 5 | 656 |
| 24 | 31 | 24,000 | 744,000 | 36.6 | 230 | 7,130 | 22,000 | 5 | 656 |
| 25 | 31 | 24,000 | 744,000 | 36.6 | 230 | 7,130 | 22,000 | 5 | 656 |
| 26 | 28 | 24,000 | 672,000 | 35.8 | 225 | 6,300 | 22,000 | 5 | 671 |
| 27 | 31 | 24,000 | 744,000 | 35.8 | 225 | 6,975 | 22,000 | 5 | 671 |
| 28 | 30 | 24,000 | 720,000 | 35.8 | 225 | 6,750 | 22,000 | 5 | 671 |
| 29 | 31 | 24,000 | 744,000 | 35.8 | 225 | 6,975 | 22,000 | 5 | 671 |
| 30 | 30 | 24,000 | 720,000 | 35.8 | 225 | 6,750 | 22,000 | 5 | 671 |
| 31 | 31 | 24,000 | 744,000 | 35.0 | 220 | 6,820 | 22,000 | 5 | 686 |
| 32 | 31 | 24,000 | 744,000 | 35.0 | 220 | 6,820 | 22,000 | 5 | 686 |
| 33 | 30 | 24,000 | 720,000 | 34.2 | 215 | 6,450 | 22,000 | 5 | 702 |
| 34 | 31 | 24,000 | 744,000 | 34.2 | 215 | 6,665 | 22,000 | 5 | 702 |
| 35 | 30 | 24,000 | 720,000 | 33.4 | 210 | 6,300 | 22,000 | 5 | 719 |
| 36 | 31 | 24,000 | 744,000 | 33.4 | 210 | 6,510 | 22,000 | 5 | 719 |
| 37 | 31 | 24,000 | 744,000 | 31.8 | 200 | 6,200 | 22,000 | 5 | 755 |
| 38 | 28 | 24,000 | 672,000 | 31.8 | 200 | 5,600 | 22,000 | 5 | 755 |
| 39 | 31 | 24,000 | 744,000 | 30.2 | 190 | 5,890 | 22,000 | 5 | 795 |
| 40 | 30 | 24,000 | 720,000 | 30.2 | 190 | 5,700 | 22,000 | 5 | 795 |
| 41 | 31 | 24,000 | 744,000 | 28.6 | 180 | 5,580 | 22,000 | 5 | 839 |
| 42 | 30 | 24,000 | 720,000 | 28.6 | 180 | 5,400 | 22,000 | 5 | 839 |
| 43 | 31 | 24,000 | 744,000 | 27.0 | 170 | 5,270 | 22,000 | 5 | 888 |
| 44 | 31 | 24,000 | 744,000 | 27.0 | 170 | 5,270 | 22,000 | 5 | 888 |
| 45 | 30 | 24,000 | 720,000 | 27.0 | 170 | 5,100 | 22,000 | 5 | 888 |
| 46 | 31 | 24,000 | 744,000 | 26.2 | 165 | 5,115 | 22,000 | 5 | 915 |
| 47 | 30 | 24,000 | 720,000 | 25.4 | 160 | 4,800 | 22,200 | 5 | 943 |
| 48 | 31 | 24,000 | 744,000 | 24.6 | 155 | 4,805 | 22,200 | 5 | 974 |
| 49 | 31 | 24,000 | 744,000 | 23.8 | 150 | 4,650 | 22,200 | 5 | 1,006 |
| 50 | 28 | 24,000 | 672,000 | 23.1 | 145 | 4,060 | 22,200 | 5 | 1,041 |
| 51 | 31 | 24,000 | 744,000 | 22.3 | 140 | 4,340 | 22,200 | 5 | 1,078 |
| 52 | 30 | 24,000 | 720,000 | 21.5 | 135 | 4,050 | 22,200 | 5 | 1,118 |
| 53 | 31 | 24,000 | 744,000 | 21.5 | 135 | 4,185 | 22,200 | 5 | 1,118 |
| 54 | 30 | 24,000 | 720,000 | 20.7 | 130 | 3,900 | 22,200 | 5 | 1,161 |
| 55 | 31 | 24,000 | 744,000 | 19.9 | 125 | 3,875 | 22,200 | 5 | 1,208 |

TABLE 11-continued

| Oil production performance during the air injection phase | | | | | | | | | |
|---|---|---|---|---|---|---|---|---|---|
| | Days per | Air Injection | | Oil Production | | | Off Gas Production | Water Production | AOR |
| Month | Month | [$Sm^3$/d] | [$Sm^3$] | [$m^3$/d] | [bbl/d] | [bbl] | [$m^3$/d] | [$m^3$/d] | [$Sm^3/m^3$] |
| 56 | 31 | 24,000 | 744,000 | 19.1 | 120 | 3,720 | 22,200 | 5 | 1,258 |
| 57 | 30 | 24,000 | 720,000 | 18.3 | 115 | 3,450 | 22,200 | 5 | 1,313 |
| 58 | 31 | 24,000 | 744,000 | 17.5 | 110 | 3,410 | 22,200 | 5 | 1,372 |
| 59 | 30 | 24,000 | 720,000 | 17.5 | 110 | 3,300 | 22,200 | 5 | 1,372 |
| 60 | 31 | 24,000 | 744,000 | 15.9 | 100 | 3,100 | 22,400 | 5 | 1,510 |
| 61 | 31 | 24,000 | 744,000 | 15.9 | 100 | 3,100 | 22,400 | 5 | 1,510 |
| 62 | 28 | 24,000 | 672,000 | 15.1 | 95 | 2,660 | 22,400 | 5 | 1,589 |
| 63 | 31 | 24,000 | 744,000 | 14.3 | 90 | 2,790 | 22,400 | 5 | 1,677 |
| 64 | 30 | 24,000 | 720,000 | 13.5 | 85 | 2,550 | 22,400 | 5 | 1,776 |
| 65 | 31 | 24,000 | 744,000 | 13.5 | 85 | 2,635 | 22,600 | 5 | 1,776 |
| 66 | 30 | 24,000 | 720,000 | 12.7 | 80 | 2,400 | 22,600 | 5 | 1,887 |
| 67 | 31 | 24,000 | 744,000 | 12.7 | 80 | 2,480 | 22,600 | 5 | 1,887 |
| 68 | 31 | 24,000 | 744,000 | 11.9 | 75 | 2,325 | 22,600 | 5 | 2,013 |
| 69 | 30 | 24,000 | 720,000 | 11.9 | 75 | 2,250 | 22,600 | 5 | 2,013 |
| 70 | 31 | 24,000 | 744,000 | 11.1 | 70 | 2,170 | 22,600 | 5 | 2,157 |
| 71 | 30 | 24,000 | 720,000 | 11.1 | 70 | 2,100 | 22,600 | 5 | 2,157 |
| 72 | 31 | 24,000 | 744,000 | 11.1 | 70 | 2,170 | 22,600 | 5 | 2,157 |

The simulation results presented in Table 11 assumed perfect sealing between the tubing string and the well liner. Sensitivity studies using air leakage rates of up to 20% of the total injected air, showed only a small reduction of the oil production and a small increase in AOR. These results show that a perfect seal is not required between the tubing string which is moved periodically and the well liner.

Example 3: Reservoir Modelling Sensitivities

Reservoir modelling sensitivities for air injection in-situ combustion were carried out, according to the following procedure for steam linking and air injection for recovery of petroleum from a hydrocarbon-bearing subterranean formation, the formation being intersected by a completed well-pair including a generally horizontal injection well and a generally horizontal production well (see, FIGS. 1-5): 1) Start steam circulation (to surface) at the completed production well horizontal at a maximum steam injection flow rate of 4.56 $m^3$/h (Tubing T1)—steam temperature 320° C. 2) Continue with steam circulation at the completed production horizontal until the production well heel reaches 100° C.—at this temperature the heavy oil flows. 3) Switch from steam circulation to only steam injection with flow being resultant at a maximum well pressure limit of 4000 kPag. 4) Stop steam injection on the completed production well once 4,000 kPag is reached. Allow steam to soak until the completed production well pressure reaches 3,750 kPag at any point along the production horizontal or when the temperature goes below 80° C. 5) Produce/pump oil at the completed production horizontal until the production rate is 25% of maximum or the production well heel temperature goes below 80° C. 6) Repeat steps 1 to 5 until injection and production is linked with a minimum temperature of 65° C. on the completed injection horizontal well. 7) Start steam injection into the completed injection horizontal up to a maximum downhole pressure of 4,000 kPag. 8) Inject steam at both wells until the ignition temperature is reached at 200-220° C. in the completed injection horizontal. At the same time, maintain production via the production well screw pump to establish a liquid level of 5-10 kPa above the production well pressure of 3,750 kPag. 9) Stop steam injection at the completed production well. 10) Review injection well temperature profile and retract the air injection location towards the edge of the combustion zone (by 15-20 m), while still injecting steam. 11) Inject Nitrogen purge at low flow rate, while maintaining steam injection at the completed injection well. 12) Stop steam injection and start air injection at 500 $Sm^3$/h when the formation heats up to the auto-ignition temperature (200-220° C.), maintain injection and production wells below 4,000 kPag by cutting back on air injection. 13) Start water injection at the completed injection well to maintain the injection well temperature below 450° C. 14) Start quench oil injection on the completed production well to maintain the production well temperature above 80° C. and below 400° C. 15) Adjust air injection flow rate to maintain the required oxygen flux to sustain the in-situ combustion process by monitoring the following: a) injection and production horizontal well temperatures (>80° C. (increase air) and <450° C. (decrease air)); b) produced off-gas composition (if $CO_2$ increases, decrease air injection rate); and c) monitor air (injection) to oil (production) ratio to be within 750-2000 $Sm^3/m^3$. 16) Retract the completed injection well tubing string **6*m*** every 60 days to provide and average retraction rate of 0.1 m/d. Alternatively, if combustion temperatures decrease and $CO^2$ composition decrease, an earlier retraction is warranted. The results are set forth in Table 12 for the Cases A-F.

Case A illustrates the implementation of well completions with a single point injection and a horizontal well pay zone of 100 m, representing a portion of an entire reservoir. A smaller pay zone was used to ensure that simulations could be completed quickly so as to study the effect of the operational and reservoir characteristics. Case A used 5,000 $Sm^3$/d air injection and 0.1 m/d retraction. The total real time of each simulation was 1,000 days.

In Case B, air injection was increased from 5,000 $Sm^3$/d to 8,000 $Sm^3$/d (60% increase). As illustrated in Table 12, this improved the cumulative oil production rate by 9.4% from 3,052 $m^3$ to 3,339 $m^3$. Air-to-oil ratio increased by about 40.5%, from about 900 to 1300. The heat distribution profile improved with the combustion hot zone being well connected with the earlier zone after the retraction was made.

In Case C a doubling of the reservoir porosity (from 26% to 52%) and horizontal permeability (from 4,000 mD to 8,000 mD) was studied. These changes had a significant impact on oil production. Air-to-oil ratio decreased by 40% (from 1250 to 750) and cumulative oil production increased by 68.6% (from 3,338 $m^3$ to 5,628 $m^3$).

In Case D, water injection into the horizontal well was simulated. Water injection could be used to manage the local temperature of the horizontal well completion to ensure that it does not exceed a safe temperature for maintaining its mechanical integrity during operations. Water injection slightly reduced the cumulative oil production (by around 7%) and increased the air oil ratio (by around 6%). Water injection was effective in cooling the horizontal well.

In Case E, increasing reservoir thickness above the injection well was studied. The reservoir thickness was increased by 20 m. This had a significant impact on oil production rate and is explained by the fact that relative heat loss in a thicker reservoir is much lower than in a thin reservoir. Therefore more combustion heat is available to mobilise oil. This change improved the cumulative oil production by 38% (from 3,339 to 4,606 $m^3$), while the air-to-oil ratio decreased by 30% (from 1,300 to 900).

In Case F, shows the effect of increasing oxidant purity from air (21% $O_2$) to 50% $O_2$. This improved cumulative oil production by 15% (from 3,339 to 3,820 m3) and reduced the oxidant to oil ratio.

TABLE 12

Cumulative oil production and Air Oil Ratio for five sensitivity cases

| Case | A | B | C | D | E | F |
|---|---|---|---|---|---|---|
| Air Injection | Air Injection 5,000 Sm3/d | Air Injection 8,000 Sm3/d | Air Injection 8,000 Sm3/d | Air Injection 8,000 Sm3/d | Air Injection 8,000 Sm3/d | Air Injection 8,000 Sm3/d |
| Other Parameters | | | Higher Porosity and Permeability | Water Injection | Increased Reservoir Thickness | Enriched Air (50% O2) |
| Cumulative Oil (M3) | 3,052 | 3,339 | 5,628 | 3,085 | 4,606 | 3,820 |
| Air Oil Ratio (M3/M3) | 900 | 1300 | 750 | 1375 | 900 | 650 |

Reference throughout this specification to "one embodiment" or "an embodiment" means that a particular feature, structure, or characteristic described in connection with the embodiment is included in at least one embodiment of the present invention. Thus, the appearance of the phrases "in one embodiment" or "in an embodiment" in various places throughout this specification are not necessarily all referring to the same embodiment. Furthermore, the particular features, structures, or characteristics can be combined in any suitable manner in one or more combinations.

Throughout the specification the aim has been to describe the preferred embodiments of the invention without limiting the invention to any one embodiment or specific collection of features. It will therefore be appreciated by those of skill in the art that, in light of the instant disclosure, various modifications and changes can be made in the particular embodiments exemplified without departing from the scope of the present invention.

The invention claimed is:

1. A method for in situ combustion (ISC) of a hydrocarbon material bearing subterranean formation, wherein the formation is intersected by at least one completed well-pair comprising a first generally horizontal well and a second generally horizontal well situated below the first well, and wherein the first and the second wells comprise a horizontal well liner that further comprises a plurality of perforations spaced along substantially a length of the well liner, and said method of recovering petroleum comprising:

a. positioning a tubing string in the first well and in the second well wherein the tubing string is configured for multi-point injection at multiple points along a length of the tubing string;

b. injecting steam via some of the multiple points along the length of the tubing string positioned in the first well and/or in the second well into the formation;

c. withdrawing, from the second well, petroleum that moves downwardly in the formation and flows into the second well;

d. replacing steam injection into the formation via the tubing string positioned in the first well with an oxidant injection, via some of the multiple points along a length of the tubing string, once the temperature of a region of the formation proximate the first well reaches the auto-ignition temperature of in-situ hydrocarbons, whereby auto-ignition of the in-situ hydrocarbon material commences and thereby forms one or more combustion zones;

e. withdrawing, from the second well, petroleum that moves downwardly in the formation and flows into the second well;

f. moving the tubing string positioned in the first well while maintaining the oxidant injection into the formation to maintain combustion of the in-situ hydrocarbon material, the moving comprising:

changing the multiple points of the oxidant injection along the length of the tubing string from an initial location of multiple points of injection to a changed location of multiple points of injection, wherein some of the changed location of multiple points of injection overlap with some of the initial locations of multiple points of injection to ensure that one or more of the combustion zones are always supplied with an oxidant, and wherein some of the changed locations of multiple points of injection being positioned adjacent to the one or more of the combustion zones thereby allowing the injected oxidant to be exposed to uncombusted hydrocarbon material, and wherein over time, as the tubing string is moved along an axis of the first well, one or more of the combustion zones move through the hydrocarbon material; and g. continuing to withdraw, from the second well, petroleum that moves downwardly in the formation and flows into the second well.

2. The method of claim 1, wherein the tubing string is a dual tubing string.

3. The method of claim 1, wherein the multi-point injection comprises a plurality of apertures along substantially a length of the tubing string.

4. A method for the in-situ combustion (ISC) of a hydrocarbon material, the method including the steps of:

a. injecting an oxidant into the hydrocarbon material at some of multiple points along a length of the hydrocarbon material Whereby auto-ignition of the hydrocarbon material commences and thereby forms one or more combustion zones; and b. changing the multiple points used along the length of the hydrocarbon material from an initial location of multiple points of injection to changed locations of multiple points of injection, wherein some of the changed locations of multiple, points of injection overlap with some of the initial location of multiple points of injection to ensure that one or more of the combustion zones is always supplied with an oxidant, wherein some of the changed locations of multiple points of injection are adjacent to one or more of the combustion zones thereby allowing the injected oxidant to be exposed to uncombusted hydrocarbon material, and wherein over time as the multiple points are changed, one or more of the combustion zones are moved through the hydrocarbon material.

5. The method of claim 4, wherein the oxidant is injected via a tubing string.

6. The method of claim 5, wherein the step of changing the multiple points used for injection along the length of the hydrocarbon material comprises moving the tubing string through a horizontal well liner comprising a plurality of perforations spaced along substantially a length of the well liner, the moving causing a change in location of some of the multiple points used for injection.

7. The method of claim 6, wherein the multiple point comprises a plurality of apertures along substantially a length of the tubing string.

8. The method of claim 7, wherein the tubing string is a concentric dual tubing string comprising apertures in both an inner tubing string and an outer tubing string.

9. The method of claim 8, wherein the outer tubing string comprises pairs of cuffs and/or pairs of seals on either side of each injection point.

10. The method of claim 9, wherein fluid from the tubing string, being water and/or steam, is injected into the annular space between the cuff and the well liner, to provide a fluid blanket to reduce leakage of the oxidant injection along the annular space and to cool the well.

11. The method of claim 9, wherein fluid from the tubing string, being water and/or steam, is injected into the annular space in the vicinity of the seal with the well liner, to provide a fluid blanket to reduce leakage of the oxidant injection along the annular space and to cool the well liner.

12. The method of claim 10 or 11, wherein the tubing string is initially positioned such that the cuffs/seals on said tubing string align with non-perforated sections of said well liner.

13. The method of claim 9, wherein the tubing string is initially positioned such that the cuffs/seals on said tubing string align with non-perforated sections of said well liner.

14. The method of claim 13, wherein the moving the tubing string comprises retracting it to a position such that at least one cuff/seal on said tubing string aligns with a non-perforated section of said well liner proximal to a distal non-perforated section of the well liner.

15. The method of claim 13, wherein the moving the tubing string comprises retracting it a distance equal to the distance between perforations.

16. The method of claim 3, wherein the perforations in the well liner are grouped together in one or more regions along the length of the well liner, alternating with non-perforated sections of the well liner, wherein the tubing string has defined therein three or five apertures equally spaced along a length of the tubing string and the retracting said tubing string comprises retracting it a distance equal to the distance between apertures.

17. The method of claim 8, wherein apertures defined in the inner tubing string are offset from apertures defined in the outer tubing string.

18. The method of claim 5, wherein the tubing string is a dual tubing string.

19. The method of claim 18, wherein the dual tubing string is a concentric dual tubing string, wherein an inner tubing string transports steam and/or water and an outer tubing string transports steam and/or oxidant.

* * * * *